US005111170A

United States Patent [19]

Ohya

[11] Patent Number: 5,111,170

[45] Date of Patent: May 5, 1992

[54] DIELECTRIC RESONATOR DEVICE

[75] Inventor: Kanji Ohya, Nagoya, Japan

[73] Assignee: NGK Spark Plug Co., Ltd., Japan

[21] Appl. No.: 717,624

[22] Filed: Jun. 19, 1991

[30] Foreign Application Priority Data

Jun. 22, 1990 [JP] Japan ..... 2-66367[U]

[51] Int. Cl.[5] ..... H01P 7/10

[52] U.S. Cl. ..... 333/219.1; 333/234

[58] Field of Search ..... 333/202, 219.1, 219, 333/234, 227, 229, 235; 331/96, 68, 69, 97, 107 DP

[56] References Cited

U.S. PATENT DOCUMENTS 4,121,181 10/1978 Nishikawa et al. ..... 333/202

4,757,289 7/1988 Kosugi et al. ..... 333/235 X 4,996,188 2/1991 Kommrusch ..... 333/227 X

FOREIGN PATENT DOCUMENTS 0288501 12/1986 Japan ..... 333/235

*Primary Examiner*—Eugene R. LaRoche

*Assistant Examiner*—Seung Ham

[57] ABSTRACT

A dielectric resonator device comprising a resonator body supported by a pedestal and a bolt for mounting the resonator body on a shield casing, the shield casing and the bolt being provided with openings for circulating a cooling gas in the shield casing, respectively. The resonator body and pedestal are formed as a unitary one-piece structure of same material.

5 Claims, 2 Drawing Sheets

DIELECTRIC RESONATOR DEVICE

BACKGROUND OF THE INVENTION

The present invention relates to a dielectric resonator device which may be used as a filter or an oscillator in microwave regions.

In FIG. 1 there is shown a conventional dielectric resonator device in which a dielectric resonator element A is mounted on an inner base wall B1 of a shield casing B via a support or pedestal C. The resonator element A is connected with the upper end of the support C by means of an adhesive layer D. The support C is connected with the base wall B1 by an adhesive layer E. This conventional arrangement has a drawback that the adhesive layers D and E can not often attend a sufficient supporting force for the resonator assembly.

In order to improve the supporting strength of the resonator there has recently been proposed another arrangement as shown in FIG. 2. In this arrangement, the resonator element A and the support C are respectively provided with inner bores A1 and C1 along the axes thereof. Through the inner bores A1 and C1 a fixing bolt F is inserted. The bolt F has a head portion F1 engaged with the upper surface of the resonator element A and a screw portion F2 extended through a through hole which is provided in the base wall B1. By threading a nut G over the screw portion F2 the resonator element A and the support C are fastened to each other and then on the base wall B1.

In such arrangements as illustrated in FIGS. 1 and 2, when the resonator device is operated, the resonator element A is self-heated with the resonance thereof. In particular, when the resonator is actuated with higher power, the higher the operation frequency is the larger the heat release value in the resonator element. Since both of the arrangements mentioned above have a poor heat dissipation capacity, they have a disadvantage that the resonance frequency of the resonator may be easily varied. For example, when the resonator is actuated with RF power having the input power of 50 Watt and the resonance frequency of 870 MHz, the temperature increment up to 125° C. is measured on the outer surface of the resonator and the temperature increment up to 200° C. on the inner portion of the resonator. This results in that the resonance frequency of the resonator is decreased by about 10%.

SUMMARY OF THE INVENTION

It is therefore an object of the present invention to provide a dielectric resonator device having an excellent heat dissipation to avoid any increasing in temperature during the operation.

According to the present invention, there is provided a dielectric resonator device comprising a dielectric resonator body of dielectric ceramics having an inner bore provided along the axis thereof, a pedestal having an inner bore provided along the axis thereof, a shield casing for containing the resonator body and the pedestal, and a bolt inserted into the inner bores of the the resonator body and the pedestal for fastening them to each other and fixing them on the base wall of the shield casing, characterized in that the shield casing and the bolt are provided with openings for circulating a cooling gas in the shield casing, respectively.

Preferably, the resonator body and the pedestal may be integrally formed by same material.

In the preferred embodiment, the bolt has an outer diameter smaller than the inner diameter of the inner bores of the resonator body and the pedestal thereby defining a cooling gas passage between the outer surface of the bolt and the inner wall of the bores.

The cooling gas passage may be communicated with the opening of the bolt by at least one lateral hole at lower end, and may be communicated with the interior of the casing at upper end.

The inner bores may have a shoulder with which the head portion of the bolt is engaged.

The cooling gas may be introduced into the shield casing through one of the openings provided on the bolt and the shield casing and may be discharged through the other opening. The introduced cooling gas may flow along the inner surface of each bore and the outer surface of the resonator body. Therefore, the resonator body may be effectively cooled to avoid any temperature increment during the operation of the resonator device.

The present invention will now be described by way of example with reference to the accompanying drawing:

DETAILED DESCRIPTION

Figure 1:
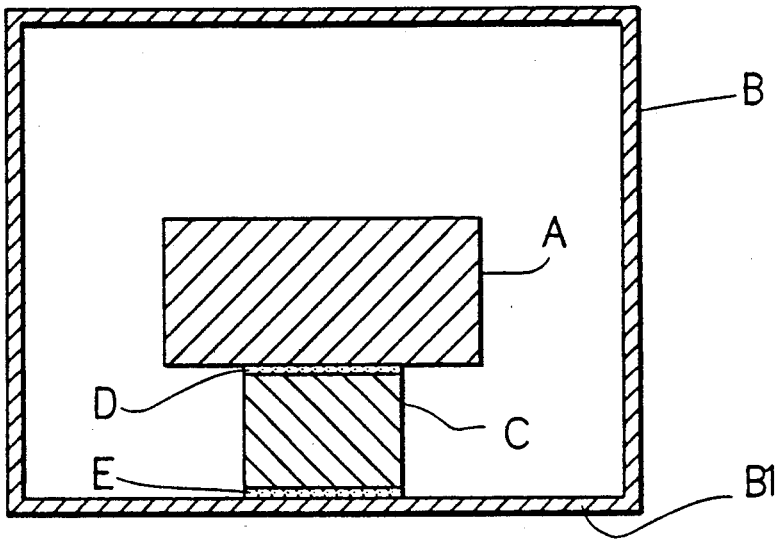
FIG. 1 PRIOR ART
FIG. 1 is a sectional view schematically showing a conventional dielectric resonator device of an adhesive mounting type.
Figure 2:
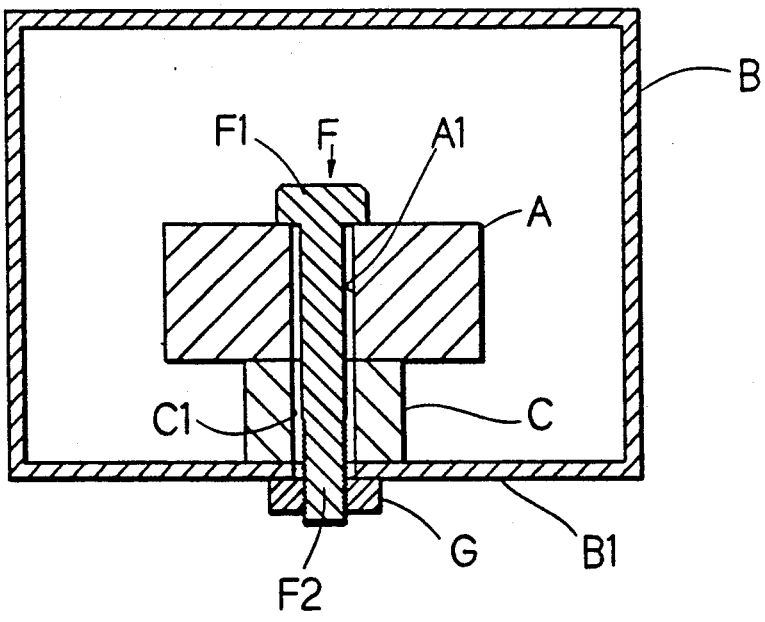
FIG. 2 PRIOR ART
FIG. 2 is a sectional view schematically showing another conventional dielectric resonator device of a bolt mounting type.
Figure 3:
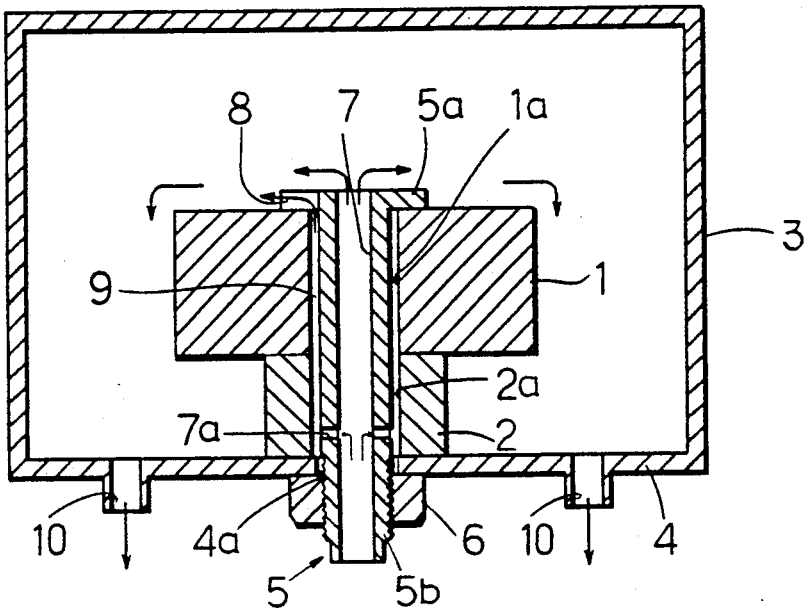
FIG. 3 is a sectional view schematically showing a dielectric resonator device according to one embodiment of the present invention.

Referring to FIG. 3, a dielectric resonator device embodying the present invention is illustrated. The resonator device comprises a dielectric resonator body 1 of a cylindrical type which may be of dielectric ceramic material having a high dielectric constant and a lower dielectric loss such as $TiO_2$, $BaO\text{-}TiO_2$. This resonator body 1 has an inner bore 1*a* and is mounted on a pedestal 2 having an inner bore 2*a* which is made of insulating material such as alumina or forsterite. The pedestal 2 is also of a cylindrical type whose outer diameter is smaller than that of the resonator body 1. The inner bore 2*a* of the pedestal has the same diameter as that of the inner bore 1*a* of the resonator body 1. The resonator body 1 and the pedestal 2 are contained in a shield casing 3. The casing 3 comprises a bottom wall 4 to which the assembly of the resonator body 1 and the pedestal 2 is attached by a fastening bolt 5 and a nut 6. The bolt 5 is inserted into the inner bores 1*a* and 2*a*, and has one end or head 5*a* engaged with the upper inner edge portion of the resonator body 1 and the other end or threaded portion 5*b* extended outward through a through hole 4*a* which is provided on the bottom wall 4. By threadedly engaging the nut 6 with the threaded portion 5*b*, the assembly of the resonator body 1 and the pedestal 2 is tightly fixed to each other and is attached to the bottom wall 4.

The bolt 5 is of a hollow type which has an opening 7 extended along the center axis thereof and also is provided with two lateral holes 7*a* near the the threaded portion 5b and slit 8 (only one of which is shown in FIG. 3) at the head 5a. The hollow bolt 5 has an outer diameter smaller than the inner diameter of the inner bores 1a and 2a so that an annular space 9 is defined therebetween. The casing 3 is provided with a plurality of openings 10 only two of which are shown in FIG. 3.

In the illustrated arrangement, a cooling gas, for example a cooling air is produced by a blower or an aspirator not shown and is introduced into the opening 7 of the bolt 5. As shown by arrows in FIG. 3 a part of the introduced cooling air flows through each lateral hole 7a into the annular space 9 and consequently the inner surfaces of the resonator body 1 and the pedestal 2 are effectively cooled. Then, the cooling air flows from the annular space 9 through the slit 8 into the casing 3. The remaining part of the cooling air flows along the opening 7 of the bolt 5 into the casing 3. The cooling air introduced into the inner space of the casing 3 flows along the outer surfaces of the resonator body 1 and the pedestal 2 so as to cool them and is discharged through the openings 10. In this way, the resonator body 1 and the pedestal 2 are cooled at the inner and outer surfaces by the cooling air flows and thus the resonator can be retained at constant and uniform temperature so that the resonator can be operated while maintaining a stable resonance characteristic.

In the illustrated embodiment, the bolt and/or the inner bores of the resonator and the pedestal may be designed so that the bolt is tightly fitted into the inner bores. In this case, the thermal energy generated on the inner surfaces of the resonator and the pedestal is directly transferred into the bolt and is dissipated by the cooling air flow through the opening of the bolt.

Figure 4:
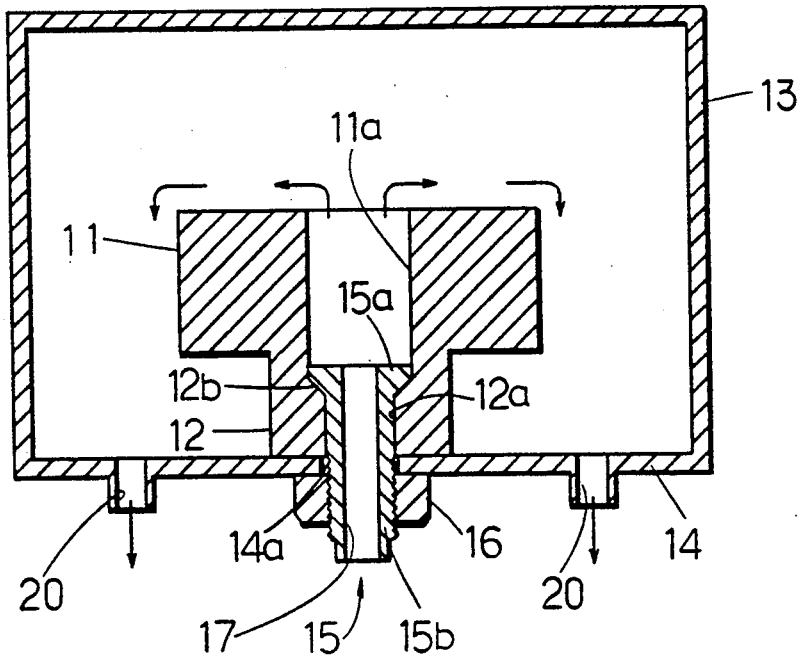
FIG. 4 is a sectional view schematically showing a dielectric resonator device according to another embodiment of the present invention.

Referring now to FIG. 4, there is illustrated another embodiment of the present invention utilizing a unitary structure of a resonator body and a pedestal.

The resonator body 11 and the pedestal 12 are integrally formed by same material so as to provide a ring shaped unitary one piece structure, and are enclosed in a shield casing 13.

The resonator body 11 and the pedestal 12 are provided with an inner bore 11a and an inner bore 12a, respectively. The inner bore 12a has a diameter smaller than that of the inner bore 11a and thus an annular shoulder 12b is formed therebetween. The casing 13 comprises a bottom wall 14 having a through hole 14a. A fastening bolt 15 of a hollow type is inserted into the inner bores 11a and 12a, and has one end or head 15a engaged with the shoulder 12b and the other end or threaded portion 15b extended outward through the hole 14a of the bottom wall 14. On the threaded portion 15b a nut 16 is tightly engaged as shown in the drawing, and thus the unitary assembly of the resonator body 11 and the pedestal 12 is mounted on the bottom wall 14 of the casing 13.

The bolt 15 has an opening 17 extended along the center axis thereof. This opening 17 is connected to a suitable cooling air supply not shown for introducing a cooling air into the casing 13.

The casing 13 is provided with a plurality of openings 20 only two of which are shown in FIG. 4 for discharging the introduced cooling air from the casing 13.

It should be appreciated that the arrangement illustrated in FIG. 4 makes it more easy to assembly or manufacture the resonator device because the resonator body 11 and the pedestal 12 are formed as the unitary one-piece structure and thus the number of the components is reduced. Moreover, since the cooling air brings into contact with the inner bore 11a of the resonator body 11 it is not necessary to provide any lateral air passage in the bolt 15 as in the arrangement of FIG. 3.

With the illustrated arrangements, instead of the bore 4a or 14a the bottom wall 4 or 14 may be provided with a threaded hole with which the bolt 5 or 15 is threadedly engaged. In such a case the nut 6 or 16 can be omitted.

Further the illustrated arrangements may be modified in such a manner that the cooling air may be introduced into the casing through the openings provided on the bottom wall of the casing and may be discharged from the casing through the opening provided in the bolt.

Furthermore, in the illustrated arrangements the resonator body and the pedestal are of ring shaped, but the present invention can be equally applied to any other shaped resonator such as a rectangular or polygonal shaped one.

It should also be understood that it is desire to introduce the cooling air into the casing after passing it through a dehumidifier and/or a filter because the resonance frequency of the resonator may be probably varied by a moisture or dust which may be contained in the cooling air.

As illustrated and described above, according to the present invention, since the resonator assembly is incorporated with a cooling gas circulating passage, the resonator body can be effectively cooled and thus can be constantly maintained at a desired temperature so as to prevent the resonance frequency of the resonator device from being varied. Therefore, the resonator device of the present invention can positively ensure a stabilized resonance characteristic.

Furthermore, by the provision of the resonator body integrated with the pedestal, the present invention has an advantage that it is possible to reduce the number of parts necessary for assembling the resonator device and to simplify the manufacture in the point of jointing procedure.

It is to be understood that the present invention is not restricted to the particular embodiments illustrated and that numerous modifications and alternations may be made by those skilled in the art without departing from the spirit and scope of the invention.

I claim:

1. A dielectric resonator device comprising a dielectric resonator body of dielectric ceramics having an inner bore provided along the axis thereof, a pedestal having an inner bore provided along the axis thereof, a shield casing for containing the resonator body and the pedestal, and a fastening member inserted into the inner bores of the the resonator body and the pedestal for fastening and fixing them on the base wall of the shield casing, wherein the shield casing and the fastening member are provided with openings for circulating a cooling gas in the shield casing, respectively.

2. A dielectric resonator device according to claim 1, wherein the fastening member has an outer diameter smaller than the inner diameter of the inner bores of the resonator body and the pedestal thereby defining a cooling gas passage between the outer surface of the fastening member and the inner wall of the respective bores.

3. A dielectric resonator device according to claim 2, wherein the fastening member includes at least one lateral hole which is communicated with the opening thereof.

4. A dielectric resonator device according to claim 1, wherein the resonator body and the pedestal are integrally formed by same material.

5. A dielectric resonator device according to claim 4, wherein the inner bore of the integrally formed resonator body and pedestal is provided with a shoulder for receiving the head of the fastening member.

* * * * *